US006979221B1

(12) United States Patent
Hunter

(10) Patent No.: US 6,979,221 B1
(45) Date of Patent: Dec. 27, 2005

(54) RETAINER FOR SECURING TWO CONNECTED ELECTRICAL CORDS

(76) Inventor: Al G. Hunter, 9800 Chander Dr., Raleigh, NC (US) 27615

( * ) Notice: Subject to any disclaimer, the term of this patent is extended or adjusted under 35 U.S.C. 154(b) by 0 days.

(21) Appl. No.: 10/917,758

(22) Filed: Aug. 13, 2004

(51) Int. Cl.[7] ..... H01R 13/62
(52) U.S. Cl. ..... 439/369
(58) Field of Search ..... 439/368–371, 439/892, 394, 356, 470; 24/129 R, 131 R, 24/129 C

(56) References Cited

U.S. PATENT DOCUMENTS

| | | | | |
|---|---|---|---|---|
| 2,461,427 A | | 2/1949 | Kneebone | 439/369 |
| 2,533,341 A | | 12/1950 | Alfano | 242/388 |
| 3,475,716 A | | 10/1969 | Laig | 439/369 |
| 4,138,185 A | | 2/1979 | Jaconette, Jr. | 439/467 |
| D259,637 S | | 6/1981 | Martin et al. | D13/139.71 |
| 4,440,465 A | | 4/1984 | Elliott et al. | 439/369 |
| 4,514,026 A | | 4/1985 | Herbert | 439/297 |
| 4,610,494 A | * | 9/1986 | Schauber | 439/453 |
| 4,690,476 A | | 9/1987 | Morgenrath | 439/502 |
| 4,957,450 A | | 9/1990 | Pioszak | 439/369 |
| 5,024,402 A | | 6/1991 | Hamel | 248/52 |
| 5,318,158 A | | 6/1994 | Seasholtz | 191/12 R |
| 5,336,106 A | * | 8/1994 | Osten | 439/369 |
| 5,423,693 A | * | 6/1995 | Light | 439/369 |
| 5,593,312 A | * | 1/1997 | McCracken | 439/369 |
| 5,628,646 A | * | 5/1997 | Voss | 439/369 |
| 5,732,445 A | | 3/1998 | Stodolka et al. | 24/16 R |
| D456,361 S | | 4/2002 | Troxell | D13/154 |
| D466,088 S | | 11/2002 | Saben | D13/154 |
| 6,537,101 B1 | | 3/2003 | Wang | 439/417 |

FOREIGN PATENT DOCUMENTS

CA 2269384 A1 * 10/2000 ..... H01R 13/639

* cited by examiner

*Primary Examiner*—Hae Moon Hyeon
(74) *Attorney, Agent, or Firm*—Coats & Bennett, P.L.L.C.

(57) ABSTRACT

A retainer receives and secures together the male and female terminal blocks of a pair of electrical cords where each cord includes an end segment that extends immediately from the male or female terminal blocks. The retainer includes a generally flat and rigid member having spaced apart first and second cord openings formed therein. A slit extends between the first and second cord openings and can be manipulated between closed and open positions. By opening the slit, the male and female terminal blocks can be inserted through the slit and the end segments extending from the terminal blocks can be moved along the slit and inserted into the cord openings. Consequently the end segments leading from the terminal blocks turn and extend through the cord openings such that the end segments are maintained out of general alignment with the male and female terminal blocks. Accordingly when tension is placed on the two electrical cords, the orientation of the end segments leading from the male and female terminal blocks tends to prevent the terminal blocks from being pulled apart.

13 Claims, 3 Drawing Sheets

RETAINER FOR SECURING TWO CONNECTED ELECTRICAL CORDS

FIELD OF THE INVENTION

The present invention relates to retainers for securing devices that are used to secure the male and female plugs of two electrical cords in a connected position.

BACKGROUND OF THE INVENTION

Electrical cords are widely used to extend access to electrical power beyond fixed outlets such as those found in and around residential and commercial buildings. Typically an electrical cord will have a male terminal block and a female terminal block and a pliable cord extending therebetween. In some cases it is common practice to connect two or more electrical cords together. This is often done by a person operating an electric leaf blower, hedge trimmer or lawn mower, for example. In the case of a leaf blower, for example, one of the most frustrating and aggravating occurrences when utilizing two or more electrical cords connected in series occurs when the operator happens to place a tension on the cords and causes a male terminal block of one cord to be pulled from the female terminal block of another adjoining cord. This obviously requires the operator to cease blowing leaves and return to the area where the disconnected cords can be retrieved and reconnected.

The separation of the cords can occur in various ways. In some instances, one part of the connected cords can become hung on a shrub or other obstacle and as the operator attempts to free the cords from the obstacle, he or she will pull or place a tension on the cord causing the male and female terminal blocks of two cords to be disconnected. In other cases the operator may be approaching the full extension of the two or three connected cords being utilized. The cords will only extend so far, and the operator of the work piece connected at the end of the cords often find himself or herself operating in an area and the cords are fully extended. Sometimes in these cases, the operator will attempt to carry the electrical devices, such as a leaf blower, further than the cords will permit. In doing so the operator will place a tension force on the cords and this tension force will be sufficient to cause the male and female terminal blocks of the cords to become disconnected.

Devices are known for retaining the male and female terminal blocks of two electrical cords together. For example, see the disclosure in U.S. Pat. Nos. 5,732,445 and 4,957,450. While these retainers do function to secure the male and female terminal blocks of two electrical cord together, they are generally difficult to use or overly complex.

There has been and continues to be a need for a relatively simple retainer for securing connected male and female terminal blocks of two electrical cords together such that if a tension force is applied on the connected electrical cords that the retainer will prevent the male and female terminal blocks from being pulled apart.

SUMMARY OF THE INVENTION

The present invention relates to a retainer for securing connected male and female terminal blocks of a pair of electrical cords where the male and female terminal blocks are electrically secured together. The retainer of the present invention includes a base having a first cord opening and a second cord opening formed therein. A slit extends between the first and second cord openings. The slit can be manipulated between a closed position and an opened position. In the open position the male and female terminal blocks can be inserted through the slit and connected together such that the male and female terminal blocks lie in a connected mode on one side of the retainer. The end segments of the two cords extending from the respective terminal blocks can be moved through the slit into the first and second cord openings. Thus, it is appreciated that the end segments of the two cords will extend from the respective terminal blocks and turn and extend through the respective cord openings and thereafter will exit the retainer on the side opposite from where the male and female terminal blocks are located. Consequently the end segments of the two cords extending from the terminal blocks will assume an orientation where they are misaligned with respect to the male and female terminal blocks held by the retainer. Hence the orientation of the end segments relative to the male and female terminal blocks will prevent a direct and aligned force from being applied to the male and female terminal blocks.

In one particular embodiment of the present invention, the retainer includes more than two cord openings. In the case of this embodiment, one or more additional cord openings can be placed between the first and second cord openings referred to above. This additional cord openings would also be placed on the retainer such that it would be open to the slit. This enables the retainer to accommodate electrical cords of various sizes.

The present invention further includes a method of retaining and securing male and female terminal blocks of two electrical cords where the male and female terminal blocks are electrically connected in conventional fashion. This method entails inserting the male and female terminal blocks of the two cords through an elongated slit formed in a retainer such that the male and female terminal blocks lie adjacent one side of the retainer in a connected position. Further the method entails manipulating the cord extending from the male terminal block to where an end segment of the cord extending from the male terminal block extends through a first cord opening that opens to the slit. Likewise the method entails manipulating the cord extending from the female terminal block to where an end segment of that cord extends through the second cord opening that also opens to the slit. This arrangement results in the end segments extending from the male and female terminal blocks turning as they extend away from the respective terminal blocks such that the end segments are routed through the first and second cord openings in such a manner that the end segments of the cord are not aligned with the terminal blocks. Hence when the male and female terminal blocks are secured on the retainer, it follows that an orientation of the end segments leading from the terminal blocks and extending through the cord openings of the retainer will have a tendency to prevent the male and female terminal blocks secured on the retainer from being pulled apart.

Other objects and advantages of the present invention will become apparent and obvious from a study of the following description and the accompanying drawings which are merely illustrative of such invention.

DETAILED DESCRIPTION OF THE INVENTION

Figure 1:
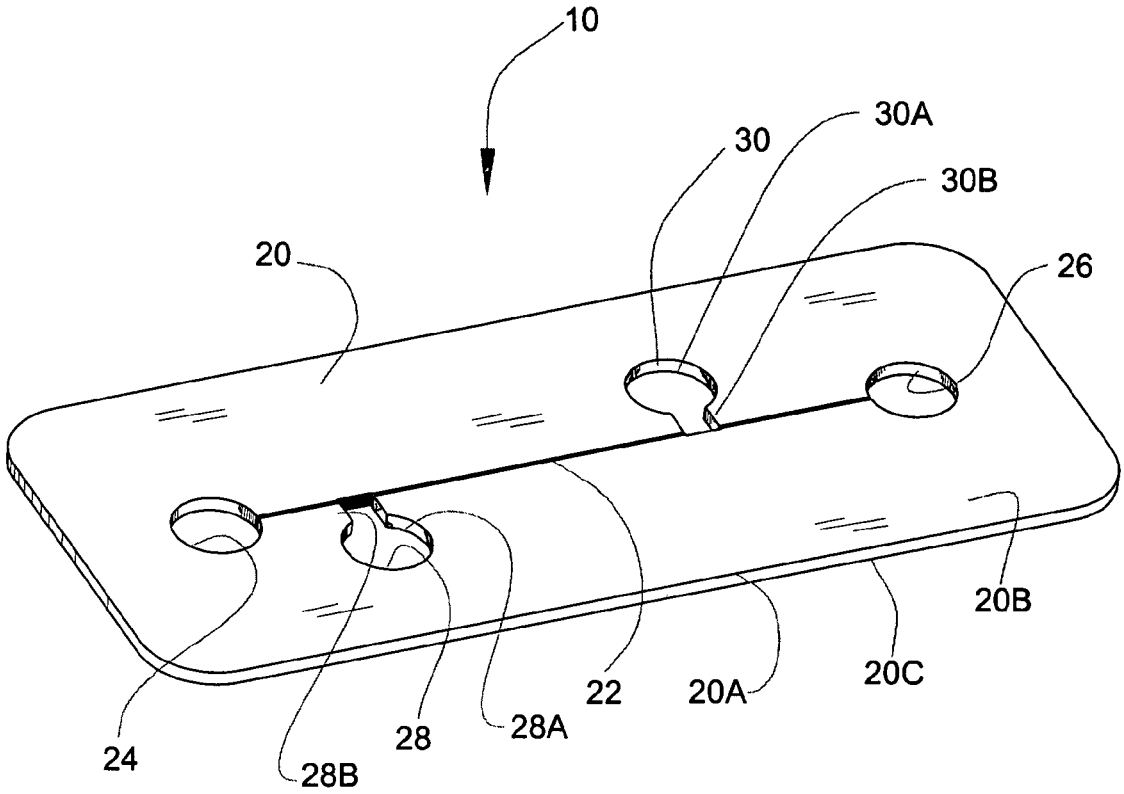
FIG. 1 is a perspective view of the electrical cord retainer of the present invention.
Figure 2:
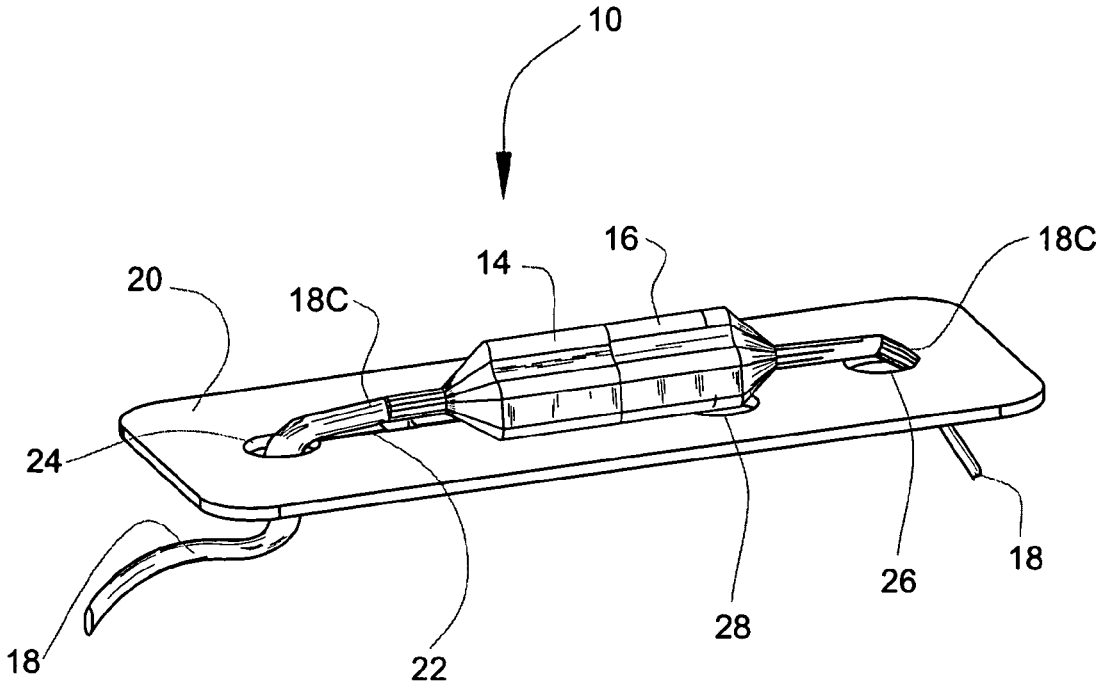
FIG. 2 is a perspective view of the retainer showing the retainer connected to the male and female terminal blocks of an electrical cord.

With further reference to the drawings, the retainer of the present invention is shown therein and indicated generally by the numeral 10. As will become apparent from subsequent discussions, the retainer 10 is designed to be secured to a pair of electrical cords. In particular, the retainer 10 is designed to be secured across the male-female connection of two electrical cords and in the process the retainer effectively directs the end segments of the cords that lead away from the male and female terminal blocks in a direction that will generally aid in preventing the male and female terminal blocks from being disconnected by tension or pulling force being exerted on the two connected cords.

Before discussing the retainer 10 in detail it will be beneficial to briefly review the basic structure of an electrical cord. In the drawings, each electrical cord is referred to by the numeral 18. Each electrical cord 18 includes a male terminal block 14 disposed on one end of the cord and a female terminal block 16 disposed on the other end of the cord. Extending between the male and female terminal blocks 14, 16 is a cord run. Cord 18 includes a segment on each end thereof that leads away from the male terminal block 14 or the female terminal block 16. This portion of the cord 18 is referred to as an end segment and is referred to by 18C. Generally, the end segment 18C of the cord is meant to mean a portion of the cord that extends from the respective terminal block. More particularly, the end segment 18C of the cord 18 includes a portion of the cord that is disposed adjacent the retainer 10 and passes through a portion of the retainer 10. For example, a segment of the cord 18 that would extend from 1 to 24 inches from a terminal block would be an end segment.

Now returning to retainer 10, the same includes a base 20. Base 20 is a relatively thin member that includes some flexibility but is generally rigid. Various types of materials may be used for the base 20, but in one embodiment it is contemplated that the material would be of plastic. As seen in the drawings the base 20 is relatively thin compared to its width and length. Base 20A includes a surrounding edge 20A and a pair of sides or surfaces 20B and 20C.

An elongated slit 22 is formed in the base 20. Slit 22 includes two opposed edges. Slit 22 is normally closed. However, the base 20 is sufficiently flexible to enable the slit to be manipulated by hand to an open position. In an open position the two edges that form the slit 22 can be sufficiently separated to allow the male terminal block 14 of one cord and the female terminal block 16 of a second cord to be inserted therethrough. The terminal blocks can be inserted through the open slits one at a time, or in the alternative, the terminal blocks can be connected together and then inserted through the open slit as a unit. The term "slit" as used herein means an elongated opening that normally assumes a closed position that prevents the male and female terminal blocks from passing through the opening but which can be enlarged to an open position where the male terminal block and the female terminal block can be passed through the opening.

Also formed in the base is a first cord opening 24. In the embodiment illustrated herein the first cord opening 24 is generally round and open to the slit 22. In this particular design, the first cord opening 24 is disposed adjacent one end of the slit 22. Likewise there is provided a second cord opening 26. Second cord opening 26 is also round and is open to the slit 22 and in the embodiment illustrated herein, is disposed at the opposite end of the slit 22.

Additional cord openings can be provided that will enable the retainer 10 to easily accommodate male and female terminals of various sizes. In this case, two additional cord openings are provided in the base 20. A third cord opening 28 is disposed adjacent the first cord opening 24. A fourth cord opening 30 is disposed adjacent the second cord opening 26. Each of the third and fourth cord openings includes a round or arcuate portion that is referred to by 28A or 30A. Further, the third and fourth cord openings 28, 30 include a rectangular or square portion that is referred to by 28B and 30B. Note that the rectangular or square portions 28B and 30B are disposed adjacent the slit 22.

The spacing of the third and fourth cord openings 28 and 30 varies with respect to the first and second cord openings 24 and 26. That is, the space between the third cord opening 28 and the first cord opening 24 is different from the spacing between the fourth cord opening 30 and the second cord opening 26. This will give the retainer 10 more flexibility in handling and accommodating different size male and female terminal blocks.

In use, the retainer is secured across the male terminal block 14 of one cord and a female terminal block 16 of another cord. In order to secure the terminal blocks 14, 16 about the retainer 10, the slit 22 is open by simply separating the edges of the slit 22. The male terminal block 14 of one cord is inserted through the opening formed by the slit 22. The female terminal block 16 of the second cord is inserted through the same opened slit. Then the male terminal block 14 is frictionally secured into the female terminal block 16 in conventional fashion. This connects the male terminal block 14 of one cord with the female terminal block 16 of the other cord. The end segment 18C of the cord leading from the male terminal block 14 is moved through the slit and inserted into the first cord opening 24. Likewise the end segment 18C leading from the female terminal block 16 is moved through the slit towards the second cord opening 26 and moved into the second cord opening 26. It is appreciated from the preceding discussion that the first and second cord openings 24 and 26 are open to the slit 22. Hence it is easy to move the end segments 18C through the slit and into the respective cord openings 24 and 26. Once the end segments 18C have been moved to where they extend through the first and second cord openings 24 and 26, it follows that the male and female terminal blocks 14 and 16 are connected together and lie on one face or surface of the base 20. Now the retainer 10 is secured to the male and female terminal blocks 14 and 16 of the two cords.

Figure 3:
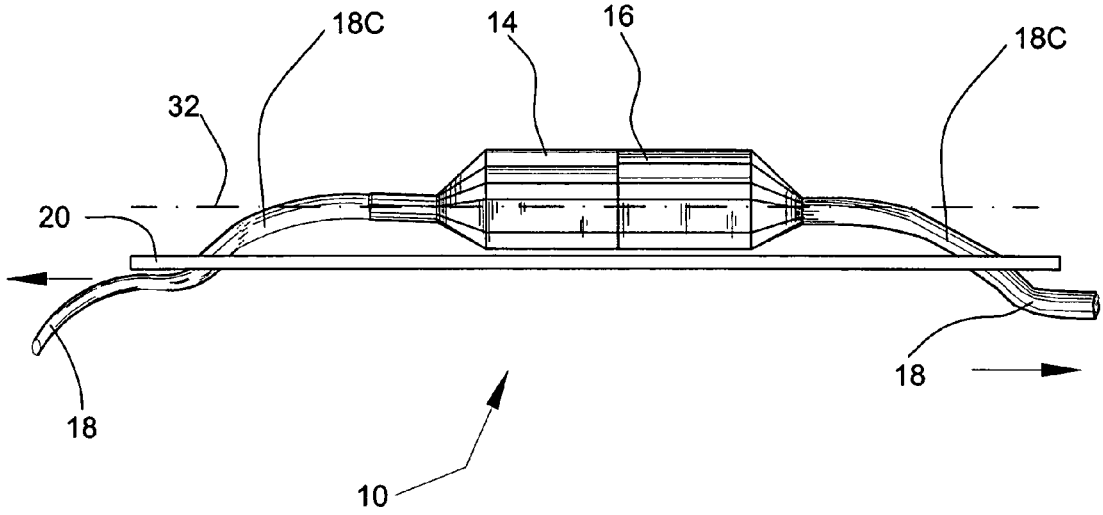
FIG. 3 is a side elevational view of the retainer shown connected to the male and female terminal blocks of a pair of electrical cords.

Note that as viewed in FIG. 3 that the end segments 18C of the respective cords are no longer free to assume a position where they would be directly aligned with the terminal blocks 14 and 16. In particular, as viewed in FIG. 3, each end segment 18C extends from a respective terminal block 14, 16 and turns and extends at an angle to the terminal blocks 14 and 16. Note, as illustrated in FIG. 3, where the end segments turn at an angle to the longitudinal axis 32 of the connected male and female terminal blocks 14, 16. In fact, the end segments 18C continue to extend through the first and second cord openings 24 and 26 to where they exit the side of the base 20 opposite the side where the male and female terminal blocks 14, 16 are located.

Therefore, as seen in FIG. 3, when the two connected cords are subjected to a pulling force or a tension, it is seen that the orientation of the end segments 18C and the relationship of the end segments 18C with respect to the retainer 10 and the male and female terminal blocks 14, 16, generally prevents the tension or pulling force from being applied in direct alignment with the terminal blocks 14, 16. Some of the tension force being applied to the cables is directed against a portion of the first and second cord openings 24 and 26. This is illustrated in FIG. 3.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

What is claimed is:

1. A retainer for securing together the male and female terminal blocks of a pair of electrical cords where each cord includes an end segment that extends from the male or female terminal blocks, the retainer comprising:

a. a base;

b. a first cord opening formed in the base for receiving one end segment of one of the electrical cords;

c. a second cord opening formed in the base for receiving the other end segment of the other electrical cord;

d. a slit formed in the base and extending from the first cord opening to the second cord opening;

e. wherein the male terminal block and female terminal block can be inserted through the slit and connected together with the end segments of the two electrical cords extending through the first and second cord openings; and f. a third cord opening positioned between the first and second cord openings, and wherein the third cord opening is opened to the slit.

2. The retainer of claim 1 wherein when the male and female terminal blocks are inserted through the slit and are connected together, each end segment extends from a respective terminal block and turns at an angle such that each end cord segment can extend through the first or second cord opening of the base.

3. The retainer of claim 1 wherein the base is generally flat and remains generally flat when the retainer secures the male and female terminal blocks of the two electrical cords together.

4. The retainer of claim 3 wherein the base is relatively thin, compared to the length of the base, and sufficiently flexible to enable the male and female terminal blocks to be inserted through the slit thereof.

5. The retainer of claim 4 wherein the base is constructed of plastic.

6. The retainer of claim 1 including a fourth cord opening positioned between the first and second cord openings and spaced from the third cord opening, and wherein the fourth cord opening is opened to the slit.

7. The retainer of claim 6 wherein the third cord opening lies adjacent the first cord opening and the fourth cord opening lies adjacent the second cord opening, and wherein the spacing between the first and third cord openings and the second and fourth cord openings are different.

8. The retainer of claim 1 wherein the third cord openings includes a generally round portion and a generally rectangular or square portion and wherein the generally rectangular or square portion opens to the slit.

9. The retainer of claim 6 wherein each of the third and fourth cord openings include a generally round portion and a generally rectangular or square portion and wherein the generally rectangular or square portion of the third and fourth cord openings open to the slit extending between the first and second cord openings.

10. The retainer of claim 1 wherein the base is configured such that when the retainer secures the male and female terminal blocks together that each end segment extending from the respective terminal blocks turns and extends generally normal to the base as the respective end cord segments extend through the first and second cord openings.

11. The retainer of claim 10 wherein when the retainer secures the male and female terminal blocks together, the orientation of the end segments relative to the male or female terminal blocks generally prevents tension forces from being directly applied in alignment with the male and female terminal blocks.

12. A retainer for securing the male and female terminal blocks of two electrical cords together, comprising:

a. a flat plastic member having a width and a length and a thickness that is relatively small compared to either the width or length of the member;

b. an elongated slit formed in the member and including a pair of edges and wherein the slit normally assumes a closed position where the edges of the slit are spaced relatively close to each other such that the male and female terminal blocks cannot freely pass therethrough;

c. wherein the flat plastic member is sufficiently flexible to enable the slit to be manipulated from the normal closed position to an open position wherein in the open position the edges of the slit are spaced apart sufficient to permit either or both of the male and female terminal blocks to pass through the open slit;

d. a first cord opening formed in the member for receiving an end segment of the cord extending from the male terminal block, the first cord opening being formed adjacent the slit and open to the slit such that the cord extending from the male terminal block can be moved through a portion of the slit into the first cord opening; and e. a second cord opening formed in the member for receiving an end segment of the cord leading from the female terminal block, the second cord opening being spaced from the first cord opening and disposed adjacent the slit and open to the slit such that a portion of the cord extending from the female terminal block can be moved through the slit into the second cord opening; and f. a third cord opening disposed generally between the first and second cord openings and wherein the third cord opening is disposed adjacent the slit and open to the slit such that a portion of cord leading from the male or female terminal blocks can be moved through a portion of the slit into the third cord opening.

13. The retainer of claim 12 including a fourth cord opening disposed between the third cord opening and one of the first or second cord openings, wherein the fourth cord opening is disposed adjacent the slit and is open to the slit such that a portion of the cord extending from either the male or female terminal blocks can be moved through a portion of the slit into the fourth cord opening.

* * * * *